US009315199B2

(12) United States Patent
Matsumoto et al.

(10) Patent No.: US 9,315,199 B2
(45) Date of Patent: Apr. 19, 2016

(54) DRIVER'S CAB AND RAILCAR INCLUDING DRIVER'S CAB

(71) Applicant: KAWASAKI JUKOGYO KABUSHIKI KAISHA, Kobe-shi, Hyogo (JP)

(72) Inventors: Mitsuhiro Matsumoto, Kobe (JP); Chihiro Okayama, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 14/388,390

(22) PCT Filed: Mar. 26, 2013

(86) PCT No.: PCT/JP2013/002056

§ 371 (c)(1),
(2) Date: Sep. 26, 2014

(87) PCT Pub. No.: WO2013/145723

PCT Pub. Date: Oct. 3, 2013

(65) Prior Publication Data

US 2015/0059614 A1 Mar. 5, 2015

(30) Foreign Application Priority Data

Mar. 27, 2012 (JP) ..... 2012-071975

(51) Int. Cl.
*B61C 17/04* (2006.01)
*B61D 17/04* (2006.01)
*B61D 17/00* (2006.01)

(52) U.S. Cl.
CPC ..... *B61C 17/04* (2013.01); *B61D 17/00* (2013.01); *B61D 17/045* (2013.01)

(58) Field of Classification Search
CPC ..... B61C 17/04; B61D 17/00; B61D 17/18; B61D 17/043; B61D 17/045; B60R 13/0206; B60R 13/02
USPC ..... 105/456, 423
See application file for complete search history.

(56) References Cited

U.S. PATENT DOCUMENTS 1,907,148 A * 5/1933 Floraday ..... 362/548
2,230,090 A * 1/1941 Rabey ..... 105/72.2

(Continued)

FOREIGN PATENT DOCUMENTS

CN 1461714 A 12/2003
EP 2193971 A2 6/2010

(Continued)

OTHER PUBLICATIONS

International Search Report issued in International Patent Application No. PCT/JP2013/002056 dated Jul. 2, 2013 (with translation).

(Continued)

*Primary Examiner* — Mark Le
(74) *Attorney, Agent, or Firm* — Oliff PLC

(57) ABSTRACT

A driver's cab of a railcar includes: side bodyshells; a roof bodyshell; and an interior panel unit including a pair of side panels located at an inner side of the side bodyshells, a ceiling panel located at an inner side of the roof bodyshell, and a back-surface panel that separates the driver's cab from a passenger room. At least one of the panels includes an opening portion through which an adjusting member can be inserted, the adjusting member being configured to adjust positions of the one panel and the side bodyshell or positions of the one panel and the roof bodyshell. An interior space of the driver's cab is defined by coupling the adjacent panels to one another. The adjusting member adjusts a position of the driver's cab relative to the side bodyshell or the roof bodyshell.

9 Claims, 4 Drawing Sheets

(56) References Cited

U.S. PATENT DOCUMENTS

| | | | | |
|---|---|---|---|---|
| 2,925,050 | A | 2/1960 | Candlin, Jr. et al. | |
| 4,100,372 | A * | 7/1978 | Hypolite | 381/1 |
| 2011/0206877 | A1 * | 8/2011 | Tada et al. | 428/35.8 |

FOREIGN PATENT DOCUMENTS

| | | |
|---|---|---|
| JP | A-11-268640 | 10/1999 |
| TW | 306433 | 5/1997 |

OTHER PUBLICATIONS

Jan. 26, 2015 Office Action issued in Taiwanese Patent Application No. 102110846 with English translation of Search Report.

Feb. 4, 2015 Office Action issued in Chinese Patent Application No. 201380015679.5 with English translation of Search Report.

* cited by examiner

DRIVER'S CAB AND RAILCAR INCLUDING DRIVER'S CAB

TECHNICAL FIELD

The present invention relates to the structure of a driver's cab and the structure of a railcar including the driver's cab.

BACKGROUND ART

A railcar typically adopts a dual structure constituted by a bodyshell and an interior member provided at an interior side of the bodyshell. The bodyshell is formed by welding metal, such as stainless steel or aluminum. Therefore, welding distortion occurs at the bodyshells in a manufacturing process, so that size differences among the bodyshells are comparatively large. Further, since the interior member is attached to an internal frame configured at the interior side of the bodyshell, the interior member has to be a member that is easy for a worker to attach and handle. To, for example, secure a wide interior space, a thin member is used as the interior member in many cases. In order that an internal size of the driver's cab becomes constant, a liner having an appropriate thickness is inserted between the internal frame and the interior member.

A large number of devices, such as a control device, are arranged in the driver's cab. These devices are attached to the internal frame of the bodyshell. However, the position of the internal frame may be displaced from a predetermined position by the welding distortion. In this case, it is necessary to, in manufacturing steps, make screw holes with a tap and adjust the positions of attachment holes of machinery and the positions of the screw holes. As above, there are problems that: the welding distortion of the bodyshell of the narrow driver's cab to which a large number of devices are attached significantly affects the steps; and it is difficult to perform efficient manufacturing work.

Here, PTL 1 proposes a railcar manufacturing method by which an entire carbody is formed in such a manner that: a driver's cab unit including the driver's cab of the carbody and a tip end portion of the railcar is separately formed; and this driver's cab unit is combined with the other portion of the carbody. According to this manufacturing method, the cost reduction can be realized by the rationalization of the work.

CITATION LIST

Patent Literature

PTL 1: Japanese Laid-Open Patent Application Publication No. 11-268640

SUMMARY OF INVENTION

Technical Problem

However, the manufacturing method described in PTL 1 requires major work of combining the driver's cab unit with the other portion of the carbody. In addition, according to the manufacturing method of PTL 1, work of adjusting the internal size of the driver's cab and work of coupling the interior member to the bodyshell need to be performed at the same time. Therefore, there are problems that it is difficult to secure the dimensional accuracy; and the work efficiency is low. Further, in work of attaching the machinery to the internal frame of the bodyshell, it is still necessary to perform work of adjusting the positions of the machinery relative to the internal frame of the bodyshell. The present invention was made in view of the above circumstances, and an object of the present invention is to provide a railcar driver's cab whose assembly work can be efficiently performed.

Solution to Problem

A railcar driver's cab according to one aspect of the present invention includes: side bodyshells; a roof bodyshell; and an interior panel unit including a pair of side panels located at an inner side of the side bodyshells, a ceiling panel located at an inner side of the roof bodyshell, and a back-surface panel that separates the driver's cab from a passenger room, wherein: at least one of the panels includes an opening portion through which an adjusting member is inserted, the adjusting member being configured to adjust positions of the one panel and the side bodyshell or positions of the one panel and the roof bodyshell; an interior space of the driver's cab is defined by coupling the adjacent panels to one another; and the adjusting member adjusts a position of the driver's cab relative to the side bodyshell or the roof bodyshell. According to this configuration, after the internal size of the driver's cab is secured by coupling the panels to one another, the coupled panels can be coupled to the bodyshell. A position of the interior space of the driver's cab relative to the bodyshell can be adjusted by the adjusting member. Therefore, the present invention can provide a railcar driver's cab whose assembly work can be efficiently performed while easily securing dimensional accuracy.

Advantageous Effects of Invention

As above, the present invention can provide a railcar driver's cab whose assembly work can be efficiently performed.

DESCRIPTION OF EMBODIMENTS

Hereinafter, an embodiment will be explained in reference to the drawings. In the following explanations and drawings, the same reference signs are used for the same or corresponding components, and a repetition of the same explanation is avoided.

1. ENTIRE SCHEMATIC CONFIGURATION OF DRIVER'S CAB

Figure 1:
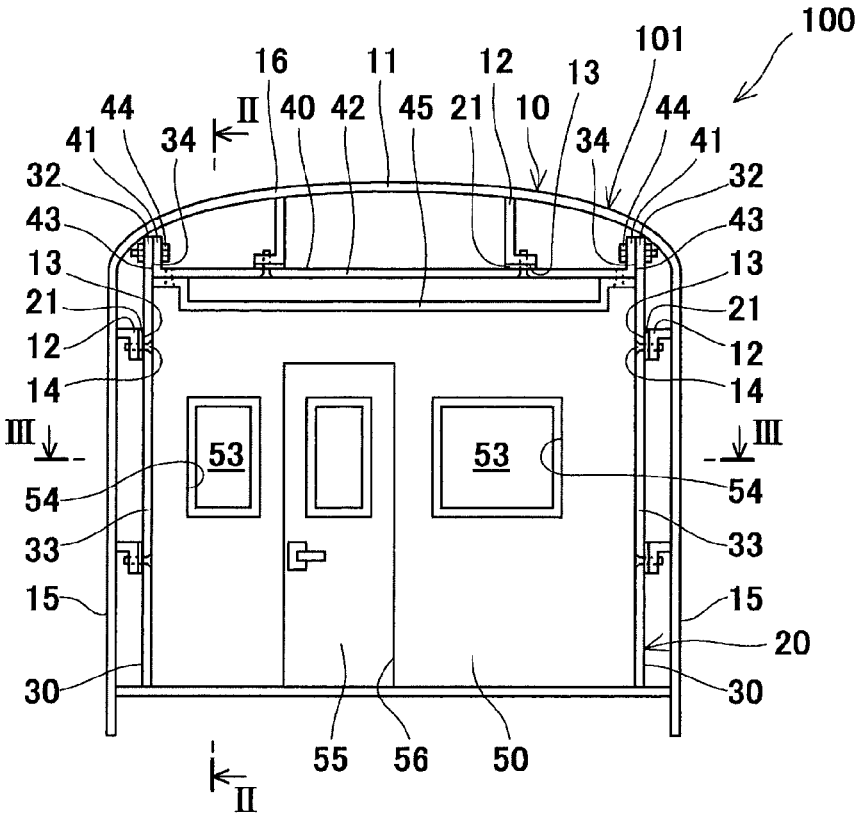
FIG. 1 is a schematic longitudinal sectional view of a driver's cab according to an embodiment.
Figure 2:
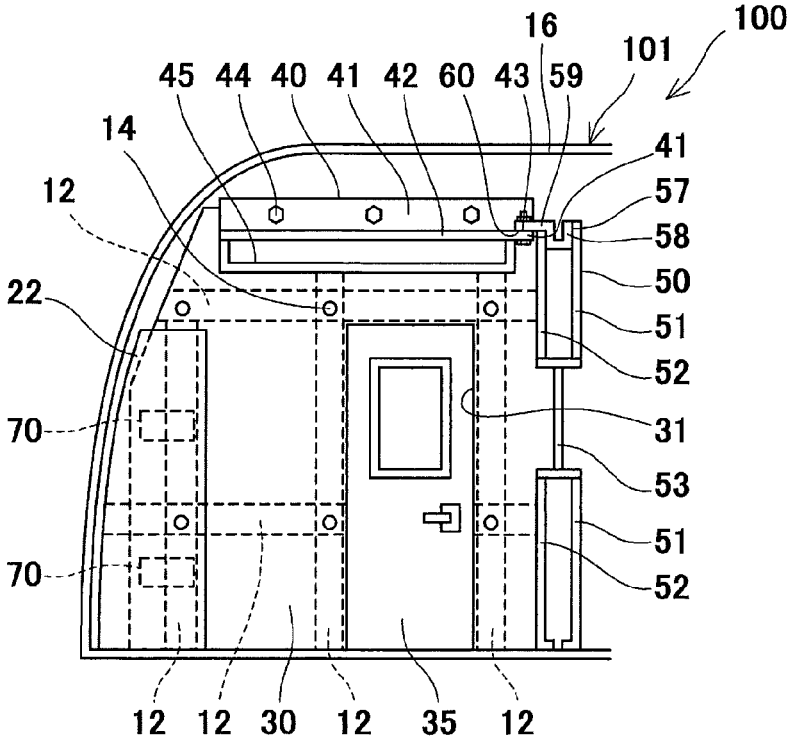
FIG. 2 is a cross-sectional view taken along line II-II of FIG. 1.
Figure 3:
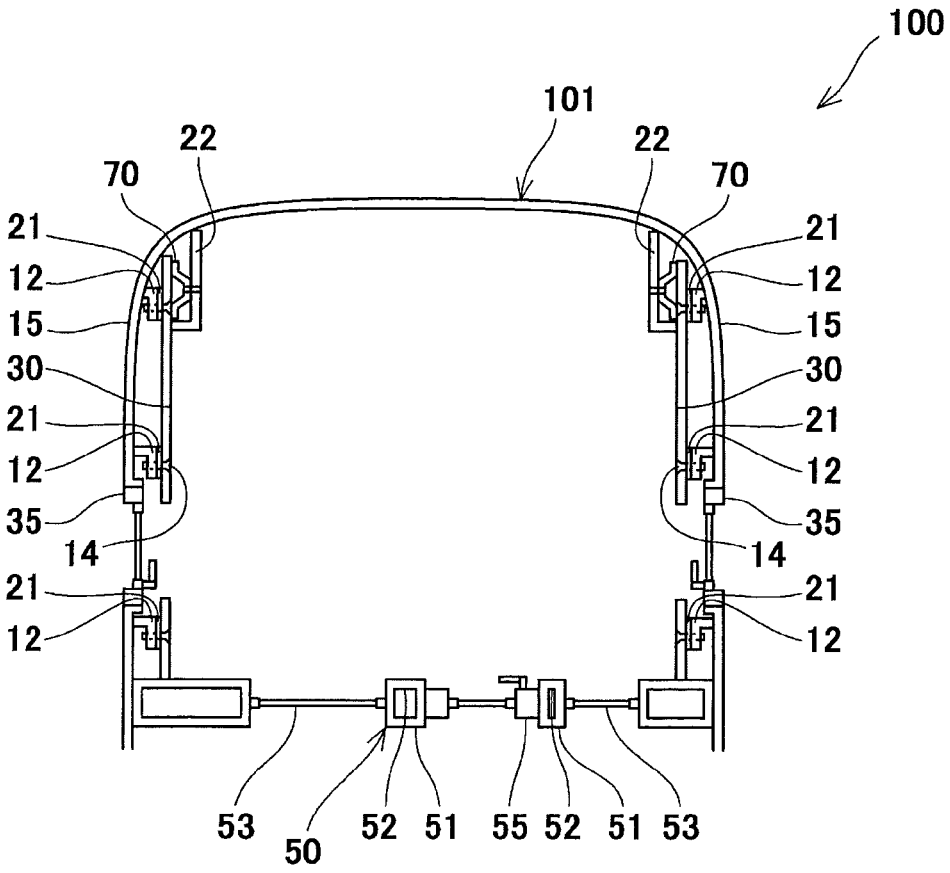
FIG. 3 is a cross-sectional view taken along line III-III of FIG. 1.

First, a driver's cab 101 of a railcar 100 according to the present embodiment will be explained in reference to FIGS. 1 to 8. FIG. 1 is a schematic longitudinal sectional view of the driver's cab 101. A left-right direction of the sheet of FIG. 1 corresponds to a railcar width direction (sleeper direction), and an upper-lower direction of the sheet of FIG. 1 corresponds to a vertical direction. A near side of the sheet of FIG. 1 corresponds to a railcar-longitudinal-direction (rail-direction) outer side (driver's cab side), and a far side of the sheet of FIG. 1 corresponds to a railcar-longitudinal-direction inner side (passenger room side). FIG. 2 is a cross-sectional view taken along line II-II of FIG. 1. FIG. 3 is a cross-sectional view taken along line of FIG. 1. FIGS. 1 to 3 do not shown machinery equipped in the driver's cab 101.

As shown in FIG. 1, the driver's cab 101 according to the present embodiment has a dual structure including a bodyshell 10 and an interior panel unit 20. As shown in FIG. 3, step-shaped screw bases 70 are attached to an interior-side surface of the interior panel unit 20. Hereinafter, the bodyshell 10, the interior panel unit 20, and the step-shaped screw base 70 will be explained in order.

2. CONFIGURATION OF BODYSHELL

The bodyshell 10 forms an outer portion of the driver's cab 101 and includes a pair of side bodyshells 15 and a roof bodyshell 16 that connects upper portions of the side bodyshells 15. The bodyshell 10 is formed by welding metal, such as stainless steel or aluminum. Therefore, as described above, the welding distortion occurs at the bodyshells 10 in a manufacturing process of the bodyshells 10, so that comparatively large size differences are caused among the railcars. As shown in FIGS. 1 and 2, the bodyshell 10 includes: a bodyshell main body 11 constituting an outer edge portion of the bodyshell 10; and internal frames 12 joined to the bodyshell main body 11 and each extending in a railcar longitudinal direction or a railcar vertical direction. Each of the internal frames 12 has, for example, an L-shaped cross section and includes an attachment surface 13 facing an interior side of the driver's cab 101. The shape of the internal frame 12, the number of internal frames 12, and the arrangement of the internal frames 12 are not especially limited and change depending on various conditions, such as the use environment of the railcar 100 and the equipment of the driver's cab 101. The internal frames 12 of the present embodiment are arranged so as to be located in the vicinity of an outer peripheral portion and opening portion of each of below-described side panels 30 and a below-described ceiling panel 40. This will be described later.

3. CONFIGURATION OF INTERIOR PANEL UNIT

The interior panel unit 20 is arranged at the interior side of the bodyshell 10 and defines an interior space of the driver's cab. The interior panel unit 20 is mainly constituted by the side panels 30, the ceiling panel 40, and a back-surface panel 50. The interior panel unit 20 has predetermined stiffness. Here, the predetermined stiffness is, for example, such stiffness that the interior panel unit 20 does not deform even if crews and passengers in the railcar apply their weight to the interior panel unit 20 and the machinery is attached to the interior panel unit 20 after the side panels 30, the ceiling panel 40, and the back-surface panel 50 are coupled to each other to be attached to the bodyshell 10. As above, since the interior panel unit 20 has the predetermined stiffness, the number of internal frames 12 in the bodyshell 10 can be made smaller than that of a conventional bodyshell. Thus, the weight of a carbody can be reduced.

4. CONFIGURATION OF SIDE PANEL

The side panels 30 are panels arranged at the interior side of the side bodyshells 15 (that is, at both railcar-width-direction sides of the driver's cab 101, respectively). Each of the side panels 30 is a plate-shaped member having predetermined stiffness, and a material thereof is not especially limited. For example, a composite plate obtained by stacking a metal plate and a non-foamed resin plate can be used as the side panel 30. Devices and wires (hereinafter may be simply referred to as "machinery") can be directly fixed to the side panels 30. With this, it becomes unnecessary to fix the machinery to the internal frames 12. Thus, the machinery can be fixed to predetermined positions without being affected by the welding distortion of the internal frame 12.

It is desirable that screw holes used to attach the devices be formed on the side panel 30 before arranging the side panel 30. With this, attachment positions of the machinery become apparent to a worker, and the adjustment of the attachment positions of the machinery becomes unnecessary. Thus, the work efficiency improves. As in conventional cases, there is a possibility that if the screw holes are made after the side panel 30 is arranged, chips get into a space between the side panel 30 and the bodyshell 10. Especially in a case where electrical devices and electric wires are arranged, the chips need to be removed in order to prevent short circuit and the like. However, by making the screw holes in advance, work of removing the chips does not have to be performed.

The side panel 30 is formed in a flat plate shape as a whole and includes: a main body portion 33 that defines the interior space of the driver's cab 101 in the railcar width direction; and a coupling portion 32 that contacts the ceiling panel 40. The coupling portion 32 includes a contact surface 34. The side panel 30 includes opening portions into each of which a below-described shim 21 (corresponding to an adjusting member) can be inserted. Examples of the opening portions include: an opening portion 31 to which an entrance door 35 for the crews shown in FIG. 2 is attached; an opening portion (not shown) through which the wire is inserted; an opening portion (not shown) to which an inspection window is attached; an opening portion (not shown) to which the device is attached; the screw holes (not shown); and a work hole (not shown) for coupling the side panel 30 to the ceiling panel 40 and the back-surface panel 50. As described above, the internal frames 12 of the bodyshell 10 are arranged in the vicinity of the outer peripheral portion and opening portion of each of the side panel 30 and the ceiling panel 40. In the present embodiment, the internal frames 12 are arranged in the vicinity of the outer peripheral portion of the side panel 30 and in the vicinity of the opening portion 31 to which the entrance door is attached. The reason why the internal frames 12 are arranged at these positions is because after the side panel 30 is arranged, work (below-described work of inserting the shim 21) with respect to the internal frames 12 through the opening portion 31 or the like is easily performed.

5. CONFIGURATION OF CEILING PANEL

The ceiling panel 40 is a panel that is arranged at the interior side of the roof bodyshell and becomes a ceiling of the driver's cab 101. The ceiling panel 40 is a plate-shaped member having stiffness, and a material thereof is not especially limited. For example, a metal plate can be used as the ceiling panel 40. As with the side panel 30, the machinery may be directly attached to the ceiling panel 40 by giving predetermined stiffness to the ceiling panel 40. The ceiling panel 30 includes opening portions. Examples of the opening portions include: opening portions to which the devices, such as a speaker, are attached; the screw holes; and a work hole for coupling the ceiling panel 40 to the side panel 30 and the back-surface panel 50. As with the side panel 30, it is preferable to form the opening portions of the ceiling panel 40 in advance. The internal frames 12 located at the ceiling side are arranged so as not to overlap the opening portion of the ceiling panel 40 and so as to be located in the vicinity of the opening portion of the ceiling panel 40. This is because work with respect to the internal frames 12 can be easily performed through the opening portion of the ceiling panel 40.

6. COUPLING OF SIDE PANEL AND CEILING PANEL

6.1 Example of Coupling of Side Panel and Ceiling Panel in Present Embodiment The ceiling panel 40 is formed in a flat plate shape as a whole and includes: a main body portion 42 that defines the interior space of the driver's cab 101 in the vertical direction; and coupling portions 41 respectively located at both railcar-width-direction end portions of the main body portion 42. Each of the coupling portions 41 is formed so as to be bent upward from the main body portion 42 and includes a contact surface 43 facing a railcar-width-direction outer side. Further, the contact surfaces 43 respectively located at both railcar-width-direction sides are formed in parallel with each other. The ceiling panel 40 and the side panel 30 are coupled to each other in a state where the contact surface 43 of the ceiling panel 40 and the contact surface 34 of the side panel 30 surface-contact each other. This coupling is performed through the work hole of the ceiling panel 40 by using connecting bolts 44 that penetrate the coupling portion 41. As above, since the side panel 30 and the ceiling panel 40 are coupled to each other in a state where the coupling portions 41 and 32 (contact surfaces 43 and 34) surface-contact each other, the ceiling panel 40 serves as a gauge. To be specific, a distance between the side panels 30 is determined based on a railcar-width-direction size of the ceiling panel 40, and the side panels 30 are arranged in parallel with each other since they are arranged along the contact surfaces 43. In the present embodiment, the coupling portions 41 of the ceiling panel 40 are formed to be bent toward an outdoor side. Therefore, the contact surfaces 43 (connecting bolts 44) are invisible from the interior side, so that the appearance does not deteriorate.

In the present embodiment, a cover panel 45 is attached to the ceiling panel 40 so s to cover a lower surface of the ceiling panel 40. By attaching the cover panel 45, the machinery attached to the ceiling panel 40 is covered. Thus, the ceiling of the driver's cab 101 can be formed so as to have a good appearance. By forming an open-close portion on the cover panel 45, the worker can reach the internal frames 12 through the open-close portion of the cover panel 45 and the opening portion of the ceiling panel 40.

As above, in the present embodiment, the ceiling panel 40 and the side panel 30 are coupled to each other in a state where the coupling portions 41 and 32 surface-contact each other. However, such configuration is not limited to the above case. For example, a coupled part where the ceiling panel 40 and the side panel 30 are coupled to each other may be configured as shown in FIGS. 4 to 7.

Figure 4:
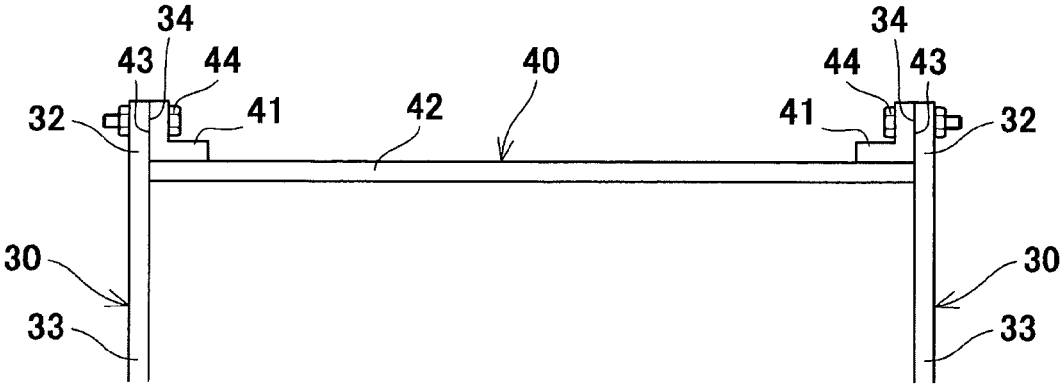
FIG. 4 is a diagram showing Modification Example 1 and related to a coupled part where a side panel and a ceiling panel shown in FIG. 1 are coupled to each other.

6.2 Modification Example 1 Regarding Coupling of Side Panel and Ceiling Panel First, FIG. 4 shows Modification Example 1 of the present embodiment and is an enlarged view of the coupled part where the side panel 30 and the ceiling panel 40 are coupled to each other. In the ceiling panel 40 of Modification Example 1, the main body portion 42 and the coupling portion 41 are made of different materials from each other. For example, the main body portion 42 is a composite plate, and the coupling portion 41 is a metal fitting. The main body portion 42 and the coupling portion 41 are adhered to each other by adhesive or the like. In a case where the main body portion 42 is made of a material that is hard to bend, it is effective to form the coupling portion 41 as a member separated from the main body portion 42 as described above.

Figure 5:
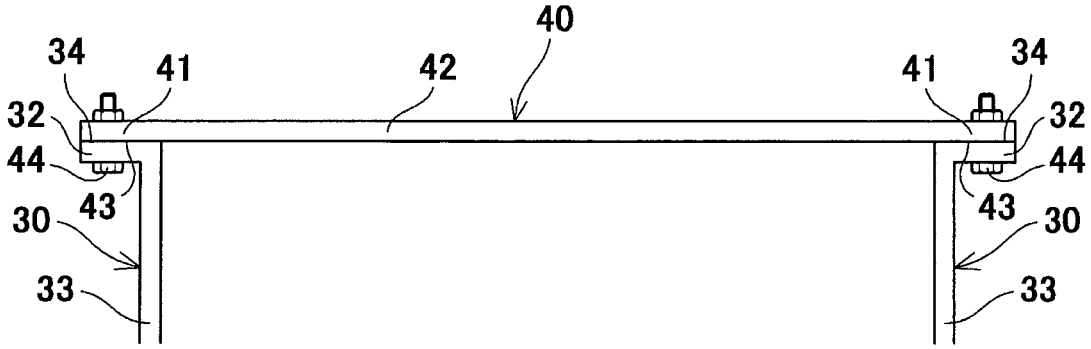
FIG. 5 is a diagram showing Modification Example 2 and related to the coupled part where the side panel and the ceiling panel shown in FIG. 1 are coupled to each other.

6.3 Modification Example 2 Regarding Coupling of Side Panel and Ceiling Panel FIG. 5 shows Modification Example 2 of the present embodiment and is an enlarged view of the coupled part where the side panel 30 and the ceiling panel 40 are coupled to each other. In Modification Example 2, the coupling portions 41 of the ceiling panel 40 are located on an extended line of the main body portion 42 (that is, the coupling portions 41 and the main body portion 42 are located on the same plane). Each of the coupling portions 32 of the side panel 30 is formed so as to be bent toward the railcar-width-direction outer side from the main body portion 33 and includes the contact surface 34 facing upward. Then, the side panel 30 and the ceiling panel 40 are coupled to each other in a state where the coupling portions 32 and 41 (contact surfaces 34 and 43) surface-contact each other. In Modification Example 2, the side panels 30 serve as gauges, so that the ceiling panel 40 can be arranged at a position of a certain height.

Figure 6:
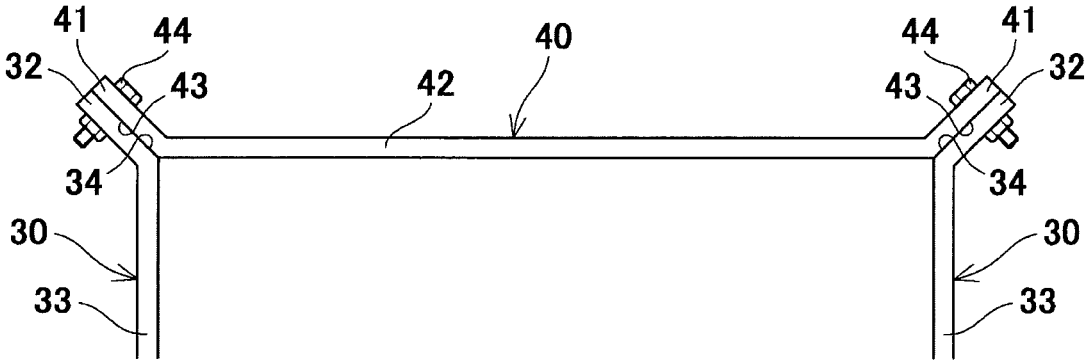
FIG. 6 is a diagram showing Modification Example 3 and related to the coupled part where the side panel and the ceiling panel shown in FIG. 1 are coupled to each other.

6.4 Modification Example 3 Regarding Coupling of Side Panel and Ceiling Panel FIG. 6 shows Modification Example 3 of the present embodiment and is an enlarged view of the coupled part where the side panel 30 and the ceiling panel 40 are coupled to each other. In Modification Example 3, each of the coupling portions 32 of the side panel 30 and the coupling portions 41 of the ceiling panel 40 is formed to be bent obliquely upward toward the railcar-width-direction outer side. The coupling portion 32 of the side panel 30 includes the contact surface 34 facing obliquely upward toward a railcar-width-direction inner side. The coupling portion 41 of the ceiling panel 40 includes the contact surface 43 facing obliquely downward toward the railcar-width-direction outer side. The side panel 30 and the ceiling panel 40 are coupled to each other in a state where the coupling portions 32 and 41 (contact surfaces 34 and 43) surface-contact each other. In this case, the ceiling panel 40 can serve as a gauge with respect to the arrangement of the side panel 30, and the side panel 30 can serve as a gauge with respect to the arrangement of the ceiling panel 40.

Figure 7:
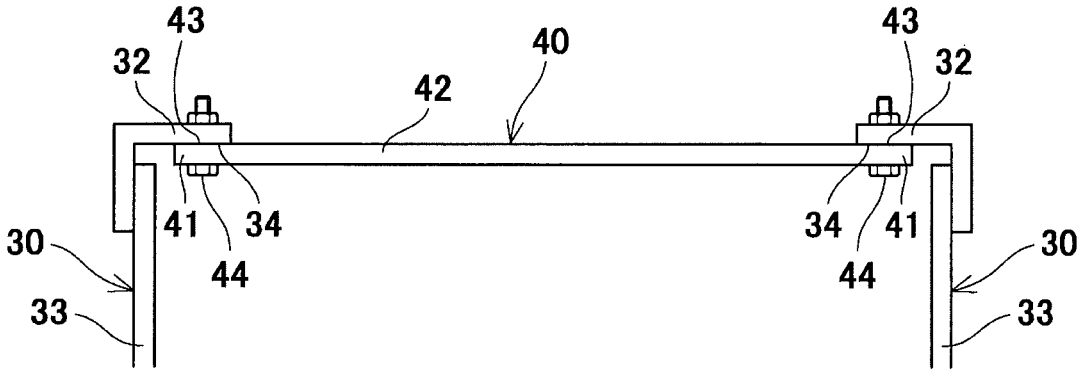
FIG. 7 is a diagram showing Modification Example 4 and related to the coupled part where the side panel and the ceiling panel shown in FIG. 1 are coupled to each other.

6.5 Modification Example 4 Regarding Coupling of Side Panel and Ceiling Panel FIG. 7 shows Modification Example 4 of the present embodiment and is an enlarged view of the coupled part where the side panel 30 and the ceiling panel 40 are coupled to each other. In Modification Example 4, the coupling portion 32 of the side panel 30 is made of a material that is different from a material of the main body portion 33. Further, the coupling portion 32 of the side panel 30 extends toward the railcar-width-direction inner side, not the railcar-width-direction outer side. In Modification Example 4, the ceiling panel 40 and the main body portion 33 of the side panel 30 are composite plates, and the coupling portion 32 is a metal fitting adhered to the main body portion 33. Even in this case, the side panel 30 can serve as a gauge with respect to the arrangement of the ceiling panel 40.

7. CONFIGURATION OF BACK-SURFACE PANEL

The back-surface panel 50 is a panel that separates the driver's cab 101 from the passenger room. The back-surface panel 50 is a plate-shaped member having stiffness. As shown in FIG. 2, the back-surface panel 50 of the present embodiment is mainly constituted by: a passenger room-side plate member 51 located at the passenger room side; and a driver's cab-side plate member 52 located at the driver's cab 101 side. These plate members 51 and 52 are arranged with a predetermined interval therebetween. A material of each of the plate members 51 and 52 is not especially limited. For example, a composite plate obtained by stacking a metal plate and a non-foamed resin plate can be used as each of the plate members 51 and 52. As shown in FIG. 1, the back-surface panel 50 includes: opening portions 54 to each of which a window glass 53 is attached; and an opening portion 56 to which a passage door 55 between the driver's cab 101 and the passenger room is attached.

As shown in FIG. 2, the back-surface panel 50 includes a coupling member 57 located at an upper portion thereof. The coupling member 57 is mainly constituted by: a fitted portion 58 having a U-shaped cross section and fitted in a space between the passenger room-side plate member 51 and the driver's cab-side plate member 52; and a coupling portion 59 horizontally extending from the fitted portion 58 toward a railcar-longitudinal-direction outer side (an inner side of the driver's cab). The coupling portion 59 includes a contact surface 60 facing downward. The back-surface panel 50 and the ceiling panel 40 are coupled to each other in a state where the contact surface 60 of the coupling portion 59 and the contact surface 43 (upper surface) of the coupling portion 41 of the ceiling panel 40 surface-contact each other. As above, the back-surface panel 50 and the ceiling panel 40 are coupled to each other in a state where the coupling portions 41 and 59 (contact surfaces 43 and 60) surface-contact each other. Therefore, the back-surface panel 50 serves as a gauge with respect to the vertical arrangement of the ceiling panel 40.

If the side panel 30 and the ceiling panel 40 are configured as in Modification Example 2 shown in FIG. 5, both the side panel 30 and the back-surface panel 50 serve as gauges with respect to the ceiling panel 40. Therefore, the function of the side panel 30 and the function the back-surface panel 50 overlap. However, in the present embodiment, the ceiling panel 40 serves as a gauge with respect to the side panel 30, and the back-surface panel 50 serves as a gauge with respect to the ceiling panel 40. Therefore, the gauge functions of these panels do not overlap, which is an efficient combination. The side panel 30 and the back-surface panel 50 may be coupled to each other so as to surface-contact each other or so as not to surface-contact each other.

As above, the interior space of the driver's cab can be defined by coupling the adjacent panels of the interior panel unit 20 to one another. With this, an interior size (internal size) of the driver's cab can be secured before coupling the interior panel unit 20 to the bodyshell 10. In addition, the machinery can be directly attached to the interior panel unit 20. Therefore, after the machinery is mounted on the interior panel unit 20, the interior panel unit 20 can be carried in the bodyshell 10. Thus, the work efficiency improves.

8. ATTACHMENT OF INTERIOR PANEL UNIT AND BODYSHELL

Next, the attachment of the interior panel unit 20 and the bodyshell 10 will be explained. As described above, since the welding distortion occurs at the bodyshell 10 formed by welding, the positioning between the side panel 30 and the bodyshell 10 and the positioning between the ceiling panel 40 and the bodyshell 10 need to be performed. Specifically, the shims 21 are respectively inserted into a gap between the side panel 30 and the internal frame 12 of the bodyshell 10 and a gap between the ceiling panel 40 and the internal frame 12 of the bodyshell 10. The position of the driver's cab 101 relative to the bodyshell 10 can be adjusted by inserting an appropriate number of shims 21 or the shim 21 having an appropriate thickness into the gaps each between the interior panel unit 20 and the bodyshell 10. In the present embodiment, the shims 21 do not have to be inserted into all the gaps each between the internal frame 12 and the interior panel unit 20 but may be inserted into a part of the gaps according to need. For example, regarding the vicinity of the opening portion 31 of the side panel 30, the shims 21 are inserted at four places in the vicinity of the opening portion 31, and fixing bolts 14 for fixing the bodyshell 10 and the interior panel unit 20 are attached to these places. As above, since the internal frames 12 are arranged in the vicinity of the opening portion within the reach of the worker, work of determining the number of shims 21 to be inserted and the thickness of the shim 21 and work of inserting the shims 21 become easy. As above, after the interior size of the driver's cab is secured, work of adjusting the position of the driver's cab relative to the bodyshell 10 can be performed. In the present embodiment, the number of portions where the bodyshell 10 and the panels contact one another (portions into which the liners are inserted) is smaller than conventional cases. This is because in the present embodiment, the interior panel unit 20 is fixed to the bodyshell 10 mainly for the purpose of preventing the positioning error of the interior panel unit 20, not for the purpose of supporting the panels (preventing the panels from falling off) as in conventional cases.

9. CONFIGURATION OF STEP-SHAPED SCREW BASE

Figure 8:
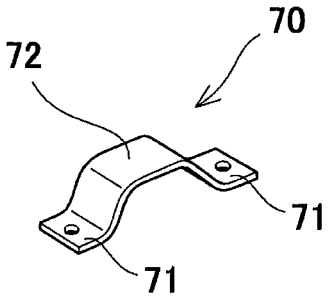
FIG. 8 is a perspective view of a step-shaped base shown in FIG. 3.

The step-shaped screw base 70 is a member on which a screw hole to which a predetermined member is fixed is formed. As shown in FIGS. 2 and 3, in the present embodiment, the step-shaped screw bases 70 are respectively attached to two places at the railcar-longitudinal-direction outer side (railcar tip end side) of the side panel 30. FIG. 8 is a perspective view of the step-shaped screw base 70. As shown in FIG. 8, the step-shaped screw base 70 is mainly constituted by fixing portions 71 and a seat portion 72. The fixing portions 71 are portions attached to the interior panel unit 20 (side panel 30) and are respectively located at both sides of the seat portion 72 so as to support the seat portion 72. The seat portion 72 is formed integrally with the fixing portions 71, separated from the fixing portions 71 toward the interior side, and formed so as to be spaced apart from the interior panel unit 20. The step-shaped screw bases 70 are fixed to the side panel 30 in advance before the side panel 30 is provided at a predetermined position.

For example, the step-shaped screw base 70 of the present embodiment is useful when attaching a cover member 22 shown in FIG. 3. The cover member 22 is provided to cover a boundary portion between the interior panel unit 20 and the bodyshell 10. A base end side of the cover member 22 is located at the interior panel unit 20 side, and a tip end side thereof is located at the bodyshell 10 side. As described above, the relative positions of the interior panel unit 20 and the bodyshell 10 change due to the welding distortion. Therefore, if the cover member 22 is attached to a predetermined position of the side panel 30, a gap between the tip end of the cover member 22 and the bodyshell 10 does not become constant. To prevent this, the screw hole for fixing the cover member 22 may be formed after the side panel 30 is provided. However, if the screw hole is directly formed on the side panel 30, a problem occurs where chips drop into the space between the side panel 30 and the bodyshell 10. In a case where the step-shaped screw base 70 of the present embodiment is used, and the screw hole is formed on the seat portion 72, the chips drop at a front side (driver's cab side) of the side panel 30, so that the problem that the chips drop into the gap between the side panel 30 and the bodyshell 10 do not occur. In the present embodiment, the step-shaped screw base 70 couples the cover member 22 to the interior panel unit 20. However, the step-shaped screw base 70 may couple the machinery to the interior panel unit 20, and a target to be coupled is not limited to these.

10. EFFECTS OF RESPECTIVE CONFIGURATIONS

As above, a railcar driver's cab according to the present embodiment includes: side bodyshells; a roof bodyshell; and an interior panel unit including a pair of side panels located at an inner side of the side bodyshells, a ceiling panel located at an inner side of the roof bodyshell, and a back-surface panel that separates the driver's cab from a passenger room, wherein: at least one of the panels includes an opening portion through which an adjusting member is inserted, the adjusting member being configured to adjust positions of the one panel and the side bodyshell or positions of the one panel and the roof bodyshell; an interior space of the driver's cab is defined by coupling the adjacent panels to one another; and the adjusting member adjusts a position of the driver's cab relative to the side bodyshell or the roof bodyshell.

According to this configuration, after the internal size of the driver's cab is secured by coupling the panels to one another, the coupled panels can be coupled to the bodyshell. A position of the interior space of the driver's cab relative to the bodyshell can be adjusted by the adjusting member. Therefore, the present invention can provide a railcar driver's cab whose assembly work can be efficiently performed while easily securing dimensional accuracy.

In the railcar driver's cab according to the present embodiment, the opening portion may be at least one of an entrance, a window opening, a device attaching portion, a screw hole, and a work hole.

According to this configuration, it is unnecessary to additionally provide an opening portion through which the adjusting member is inserted. Therefore, work steps do not increase, and convenience is high.

In the railcar driver's cab according to the present embodiment, the adjusting member may be arranged only in the vicinity of the opening portion.

According to this configuration, by inserting the adjusting member in the vicinity of the opening portion, a worker can adjust the position of the driver's cab relative to the bodyshell. Therefore, the work efficiency becomes higher than conventional cases.

The railcar driver's cab according to the present embodiment may be configured such that: the panels respectively include coupling portions by which the adjacent panels are coupled to each other in a state where the coupling portions surface-contact each other; and the interior space of the driver's cab is defined by the side panels, the ceiling panel, and the back-surface panel, which are coupled to one another.

According to this configuration, the driver's cab can be formed by coupling the panels to one another. Therefore, the work becomes easy, and the interior size of the driver's cab can be secured with a high degree of accuracy.

In the railcar driver's cab according to the present embodiment, the coupling portions may be formed so as to be bent toward an outdoor side.

According to this configuration, the interior size of the driver's cab can be secured by simple work.

In the railcar driver's cab according to the present embodiment, an electrical device and a wire for connecting the electrical device may be attached to the interior panel unit.

According to this configuration, after the electrical device and the wire are arranged, the driver's cab can be carried in the bodyshell and attached to the bodyshell. Therefore, the work efficiency improves, and the electrical device and the wire are prevented from being damaged when attaching the interior panel unit to the bodyshell.

The railcar driver's cab according to the present embodiment may further include a screw base provided at an interior-side surface of the interior panel unit, wherein the screw base may include a fixing portion attached to the interior-side surface of interior panel unit and a seat portion separated from the fixing portion toward an interior side.

According to this configuration, even in a case where the screw hole or the like needs to be formed when attaching the cover member or various devices to the interior panel unit, chips or the like do not drop into a space between the interior panel unit and the bodyshell. Therefore, the quality of the railcar can be improved, and work, such as cleaning of the chips, is unnecessary.

A railcar according to the present embodiment includes the driver's cab according to the present embodiment described above. Therefore, the assembly work can be efficiently performed from the viewpoint of the entire railcar.

The foregoing has explained the embodiment in reference to the drawings. However, specific configurations are not limited to the embodiment. Design changes and the like within the scope of the present invention are included in the present invention.

INDUSTRIAL APPLICABILITY

According to the present invention, the assembly work can be performed efficiently. Therefore, the present invention is useful in the technical field of railcars.

REFERENCE SIGNS LIST

10 bodyshell
15 side bodyshell
16 roof bodyshell
20 interior panel unit
21 shim
30 side panel
31 opening portion
32 coupling portion
33 main body portion
40 ceiling panel
41 coupling portion

42 main body portion
50 back-surface panel
59 coupling portion
70 step-shaped screw base
71 fixing portion
72 seat portion
100 railcar
101 driver's cab

The invention claimed is:

1. A railcar driver's cab comprising:
side bodyshells;
a roof bodyshell;
an interior panel unit including:
a pair of side panels located at an inner side of the side bodyshells;
a ceiling panel located at an inner side of the roof bodyshell; and
a back-surface panel that separates the driver's cab from a passenger room;
an opening portion in one of the panels through which an adjusting member is inserted, the adjusting member being configured to adjust a relative position of the one panel and one of the side bodyshells or a relative position of the one panel and the roof bodyshell;
coupling portions that couple adjacent panels to each other and are not used to couple the adjacent panels to the side bodyshells or the roof bodyshell; and
an interior space of the driver's cab defined by the side panels, the ceiling panel, and the back-surface panel, which are coupled to one another by the coupling portions to form the interior panel unit prior to coupling the panels to the bodyshells,
wherein the adjusting member adjusts a position of the driver's cab relative to the side bodyshells or the roof bodyshell.

2. The railcar driver's cab according to claim 1, wherein the opening portion is at least one of an entrance, a window opening, a device attaching portion, a screw hole, and a work hole.

3. The railcar driver's cab according to claim 1, wherein the adjusting member is arranged only in the vicinity of the opening portion.

4. The railcar driver's cab according to claim 1, wherein the coupling portions are portions of the adjacent panels that are in surface-contact with each other.

5. The railcar driver's cab according to claim 4, wherein the coupling portions are formed so as to be bent toward an outdoor side.

6. The railcar driver's cab according to claim 1, wherein an electrical device and a wire for connecting the electrical device are attached to the interior panel unit.

7. The railcar driver's cab according to claim 1, further comprising a screw base provided at an interior-side surface of the interior panel unit, wherein
the screw base includes a fixing portion attached to the interior-side surface of the interior panel unit and a seat portion separated from the fixing portion toward the interior space.

8. A railcar including the driver's cab according to claim 1.

9. The railcar driver's cab according to claim 4, wherein the adjacent panels have a flat plate shape, and the coupling portions are perpendicular to at least one of the adjacent panels.

* * * * *